US006497601B1

(12) United States Patent
Ward

(10) Patent No.: US 6,497,601 B1
(45) Date of Patent: Dec. 24, 2002

(54) FOLDING THREE DIMENSIONAL CONSTRUCTION

(76) Inventor: Eric Ward, 11150 Glenoaks Blvd., Unit No. 255, Pacoima, CA (US) 91331

( * ) Notice: Subject to any disclaimer, the term of this patent is extended or adjusted under 35 U.S.C. 154(b) by 0 days.

(21) Appl. No.: 10/132,593

(22) Filed: Apr. 24, 2002

(51) Int. Cl.[7] ..... G09F 1/00

(52) U.S. Cl. ..... 446/71; 446/488; 40/124.09; 40/124.14

(58) Field of Search ..... 446/71, 487, 488; 40/124.09, 539, 124.14; 248/174; 428/12, 542.8; 229/116.1, 108, 108.1, 103

(56) References Cited

U.S. PATENT DOCUMENTS 990,919 A * 5/1911 Steele
3,234,682 A * 2/1966 Frankl
4,619,426 A * 10/1986 Drueck, Jr. ..... 206/45.27
4,790,714 A * 12/1988 Schnapp ..... 428/12
4,854,060 A * 8/1989 Corbo et al. ..... 40/539
5,418,020 A * 5/1995 Crane ..... 428/12
5,983,538 A * 11/1999 Crowell ..... 40/124.14
6,006,457 A * 12/1999 Transport ..... 40/124.14

* cited by examiner

*Primary Examiner*—Jacob K. Ackun
(74) *Attorney, Agent, or Firm*—David A. Belasco; Belasco Jacobs & Townsley, LLP

(57) ABSTRACT

A collapsible three-dimensional construction in the form of a cube is described. The construction is formed of paperboard, pasteboard, cardboard plastic or similar material. The cube may be formed from a single sheet of die-cut material. Four of the faces of the cube include perforation lines to allow the cube to be collapsed into a flattened cube when twisted about a central axis in a first direction. Two elastic members are attached to tensioning members inside of the cube and serve to hold the cube in an erected position when twisted in a second, opposite direction. The assembly of the cube from the blank requires only a single fastening of one portion of the construction to another. The surfaces of the cube may be easily printed with advertising or promotional material.

7 Claims, 6 Drawing Sheets

FOLDING THREE DIMENSIONAL CONSTRUCTION

FIELD OF INVENTION

The invention pertains to three-dimensional constructions. More particularly, the invention relates to regular geometric constructions that are erected in three dimensions and are suitable for use as an advertising medium.

BACKGROUND OF THE INVENTION

Various designs have been developed for three-dimensional constructions for use as toys or advertising media, many of them for cubes. U.S. Pat. No. 4,854,060 issued to Corbo et al. is directed to a self-erecting paperboard photo display cube. The display cube is die cut from a sheet of paperboard into a blank. The blank has a plurality of slits for mounting corners of photos and a plurality of score lines to facilitate folding. As shown in the drawings, adhesive is applied to selected areas so as to form the cubic structure. An elastic band is passed around the left and right hook panels providing the self-erecting feature.

U.S. Pat. No. 990,919 issued to Stadler, discloses an advertising card that is held in its knockdown condition while in an envelope and sharply springs up into a generally cubic shape when it is removed from the envelope. The self-erecting advertising card is formed of a pasteboard structure mounted on a pasteboard base. The structure has a front, top, rear wall and sides. In a modified form of the invention the folding structure is formed of one-piece material. The elastic bands are connected to the sidewalls, base card and a retractile element is connected to the front wall and the free edge of the top piece. The retractile elements automatically draw the structure into an upright position when it is removed from its folded position in the envelope.

U.S. Pat. No. 3,234,682, issued to Frankl is directed to self-erecting building blocks that can be used as toys or for advertising structures. The hollow block of right rectangular transverse sections has sidewalls joined at their longitudinal edges by hinges that can be formed by scoring, embossing, creasing the sheet material, or using paper or fabric adhered to the edges. The adjacent edges of the two end parts that are triangularly shaped are connected where they meet by hinges. A tension element in the form of an elastic band is disposed within the structure under tension with its opposite ends secured to the sidewalls. At two opposed hinges, a pair of holes are connected by a slit providing a mount for looping the elastic band.

U.S. Pat. No. 4,790,714 issued to Schnapp is directed to a square or rectangular cardboard box that stores flat and self-erects when not constrained. The sheet of wood or plastic is cut into a pattern. The cut pattern has a top and bottom panel and half panels that together form a cube. The tongues that are connected to each of the half panels have holes for rubber bands to pass through. The folded box is held together by the rubber bands that also provide force to self-erect the box when it is no longer constrained in a flat condition.

U.S. Pat. No. 4,619,426 issued to Drueck, Jr. is directed to a collapsible self-erecting structure formed of pasteboard and illustrated as a cube. The cube is formed from a one-piece blank. The blank is cut and scored to form sidewalls and end walls. The cube is formed by folding on score lines, then attachment tabs on the flaps are attached to the sidewalls and the glue flap is attached to a panel. An elastic band is fixed about the attachment point of the flaps.

The self-erecting structure can have a purpose such as toys, greeting cards, advertising devices and the like.

U.S. Pat. No. 5,983,538 issued to Crowell, discloses a printing system and method for individually creating three-dimensional displays. A user employs a conventional personal computer and the three-dimensional software to generate images that are retained on a carrier sheet for use through conventional printers. An alternate embodiment of the 3D display is shown as a cube. Another self-erecting cube has a visually distinctive presentation whereby images can be printed on the outside as well as on the inside for viewing through a cutout zone.

While other variations exist, the above-described designs for three-dimensional constructions are typical of those encountered in the prior art. It is an objective of the present invention to provide for a three-dimensional construction in the form of a cube. It is a further objective to provide such a construction that can be readily collapsed into a flattened square for ease of transport and storage. It is yet a further objective to provide a cube that is easily erected from its flat storage shape without undue skill or complex instructions. It is a final objective of the invention to provide such a cube construction that can accommodate the printing of advertising on the walls of the cube.

While some of the objectives of the present invention are disclosed in the prior art, none of the inventions found include all of the requirements identified.

SUMMARY OF THE INVENTION

The present invention addresses all of the deficiencies of prior art folding three-dimensional constructions and satisfies all of the objectives described above.

A folding three-dimensional construction in the form of a cube providing the desired features may be constructed from the following components. A square front side is provided. The front side has an outer surface, an inner surface, a top edge, a bottom edge, a first side edge and a second side edge. A square first side is provided. The first side has an outer surface, an inner surface, a top edge, a bottom edge, a first side edge, a second side edge and a first diagonal perforation. The first diagonal perforation extends from an intersection of the top edge and the second side edge to an intersection of the bottom edge and the first side edge. The first side is joined at its second side edge to the first side edge of the square front side.

A square second side is provided. The second side has an outer surface, an inner surface, a top edge, a bottom edge, a first side edge, a second side edge and a second diagonal perforation, the second diagonal perforation extends from an intersection of the top edge and the second side edge to an intersection of the bottom edge and the first side edge. The second side is joined at its first side edge to the second side edge of the square front side. A square back side is provided. The back side has an outer surface, an inner surface, a top edge, a bottom edge, a first side edge and a second side edge. The back side is joined at its first side edge to the second side edge of the square second side.

A connecting tab is provided. The connecting tab is joined to the first side edge of the square first side and extends outwardly from it. The connecting tab is removably attached to the inner surface of the square back side adjacent the second side edge of the back side. A first tensioning portion is provided. The first tensioning portion is joined at an attaching edge to the top edge of the square front side and includes a first means for attaching a tensioning means. A second tensioning portion is provided. The second tensioning portion is joined at an attaching edge to the top edge of the square back side and includes a means for attaching a tensioning means.

A first tensioning means is provided. The first tensioning means is attached to the first means for attaching a tensioning means and the second means for attaching a tensioning means and urges the first tensioning portion toward the second tensioning portion. A third tensioning portion is provided. The third tensioning portion is joined at an attaching edge to the bottom edge of the square front side and includes a third means for attaching a tensioning means. A fourth tensioning portion is provided. The fourth tensioning portion is joined at an attaching edge to the bottom edge of the square back side and includes a fourth means for attaching a tensioning means. A second tensioning means is provided. The second tensioning means is attached to the third means for attaching a tensioning means and the fourth means for attaching a tensioning means and urges the third tensioning portion toward the fourth tensioning portion.

A first side top portion is provided. The first side top portion is formed as a right triangle and has a first adjacent side, a second adjacent side and a first hypotenuse. The first side top portion is joined at the first adjacent side to the top edge of the square first side and has a third diagonal perforation extending from an intersection of the top edge and the first side edge of the square first side to a center point of the first hypotenuse. The second adjacent side is removably attached to the first tensioning portion adjacent the top edge of the square front side.

A second side top portion is provided. The second side top portion is formed as a right triangle and has a third adjacent side, a fourth adjacent side and a second hypotenuse. The second side top portion is joined at the third adjacent side to the top edge of the square second side and has a fourth diagonal perforation extending from an intersection of the top edge and the first side edge of the square second side to a center point of the second hypotenuse. The fourth adjacent side is removably attached to the second tensioning portion adjacent the top edge of the square back side.

A first side bottom portion is provided. The first side bottom portion is formed as a right triangle and has a fifth adjacent side, a sixth adjacent side and a third hypotenuse. The first side bottom portion is joined at the fifth adjacent side to the bottom edge of the square first side and has a fifth diagonal perforation extending from an intersection of the bottom edge and the second side edge of the square first side to a center point of the third hypotenuse. The sixth adjacent side is removably attached to the third tensioning portion adjacent the bottom edge of the square front side.

A second side bottom portion is provided. The second side bottom portion is formed as a right triangle and has a seventh adjacent side, an eighth adjacent side and a fourth hypotenuse. The second side bottom portion is joined at the seventh adjacent side to the bottom edge of the square second side and has a sixth diagonal perforation extending from an intersection of the bottom edge and the second side edge of the square second side to a center point of the fourth hypotenuse. The eighth adjacent side is removably attached to the fourth tensioning portion adjacent the bottom edge of the square back side.

When the folding three dimensional construction in the form of a cube is twisted about the first and second diagonal perforations, the third, fourth, fifth and sixth perforations will be displaced toward a center of the cube while stretching the first and second tensioning means and the cube will then collapse into a flattened square and the tension in the first and second tensioning means will be reduced.

In a variant of the invention, the three dimensional construction is formed from a single blank.

In another variant, the construction is formed from material selected from the group includes: paperboard, corrugated cardboard, plastic and reinforced fabric.

In a further variant, the first and second tensioning means are selected from the group includes: rubber bands, elastic and coil springs.

In a further variant of the invention, the first, second, third and fourth tensioning portions include an adjoining edge. The adjoining edge intersects the attaching edge of the tensioning portions.

In a final variant of the invention, the, means for attaching a tensioning means includes an orifice. The orifice penetrates the tensioning portions and is spaced from the attaching edge and spaced from the adjoining edge. A slit is provided. The slit extends from the orifice to the adjoining edge. When an attaching end of either of the first and second tensioning means is inserted through the slit, the tensioning means will be retained in the orifice.

An appreciation of the other aims and objectives of the present invention and an understanding of it may be achieved by referring to the accompanying drawings and the detailed description of a preferred embodiment.

DETAILED DESCRIPTION OF THE PREFERRED EMBODIMENT

Figure 6:
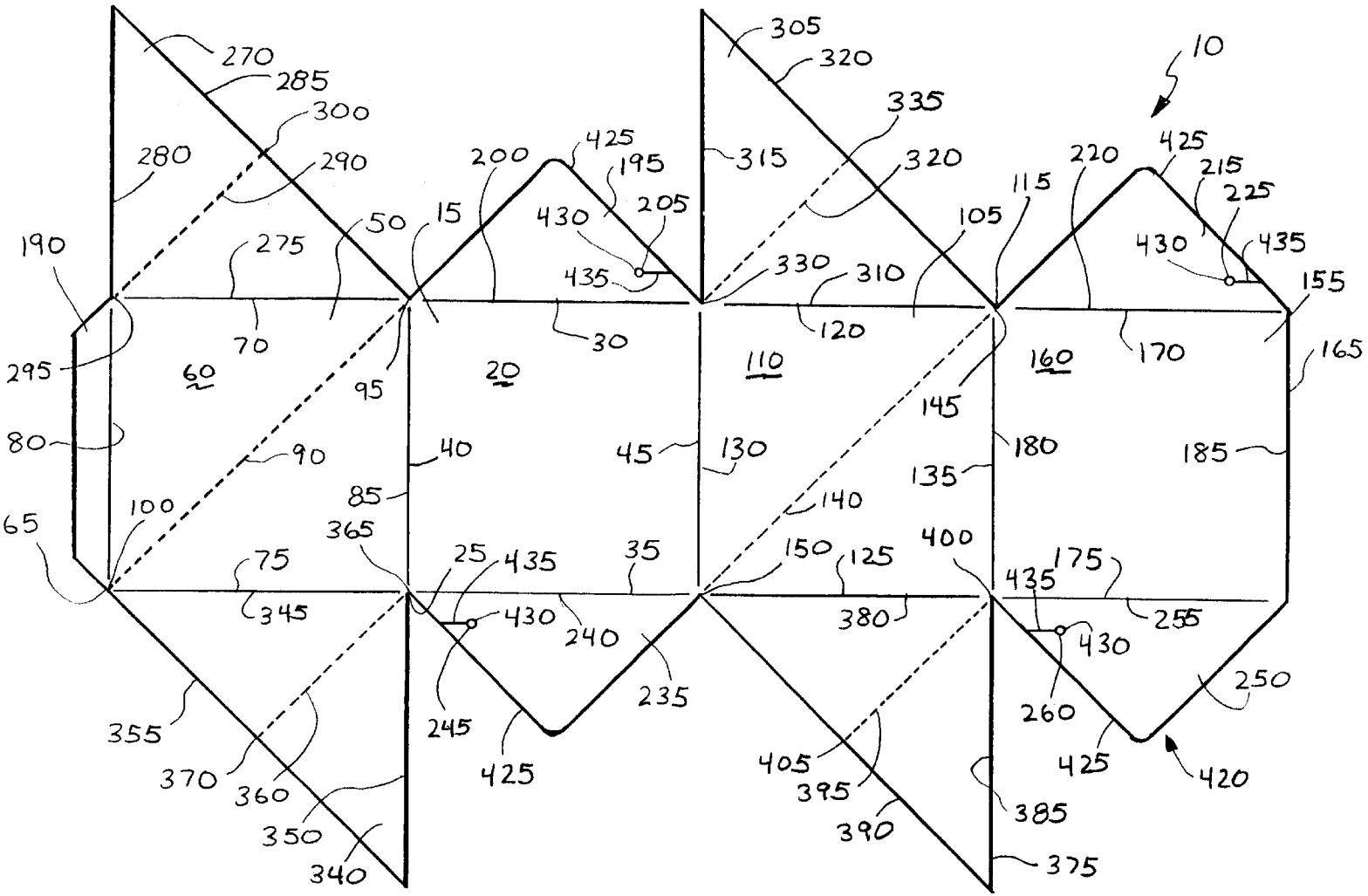
FIG. 6 is a plan view of the FIG. 1 embodiment illustrating the joining of the side and top portions, the tensioning portions and connecting tab.
Figure 7:
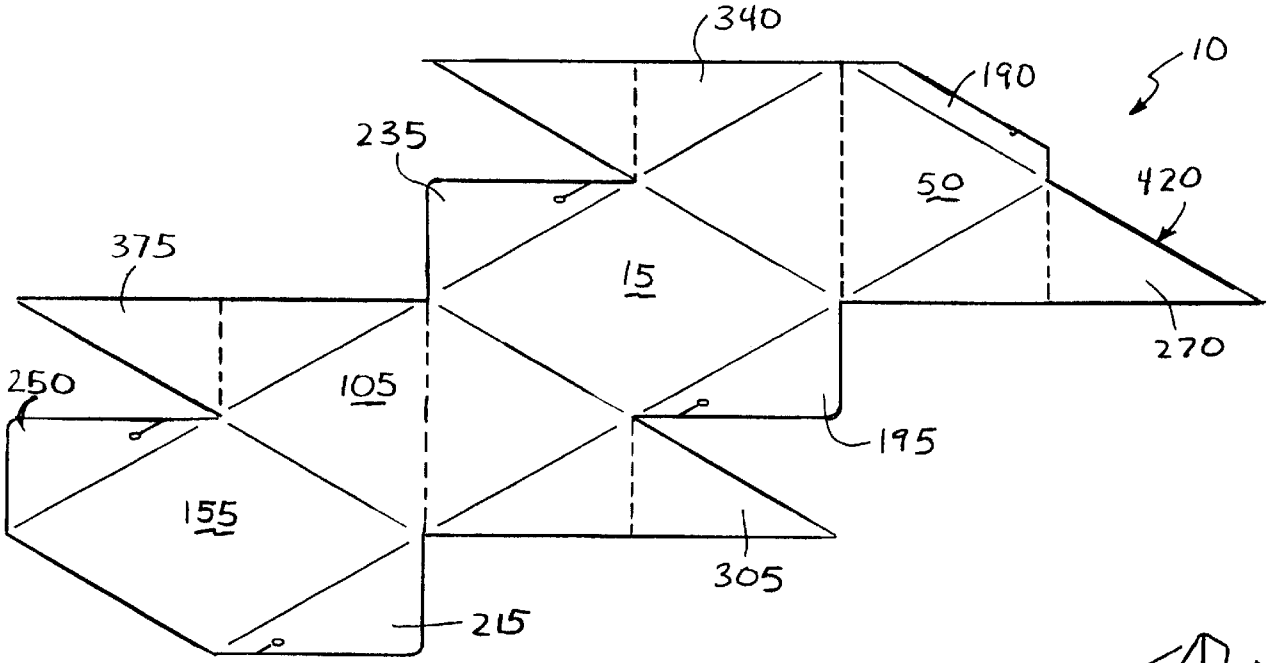
FIG. 7 is a plan view of the FIG. 1 embodiment prior to assembly.

FIGS. 1–12 illustrate a folding three dimensional construction in the form of a cube 10 providing the desired features that may be constructed from the following components. As illustrated in FIG. 6, a square front side 15 is provided. The front side 15 has an outer surface 20, an inner surface 25, a top edge 30, a bottom edge 35, a first side edge 40 and a second side edge 45. A square first side 50 is provided. The first side 50 has an outer surface 60, an inner surface 65, a top edge 70, a bottom edge 75, a first side edge 80, a second side edge 85 and a first diagonal perforation 90. The first diagonal perforation 90 extends from an intersection 95 of the top edge 70 and the second side edge 85 to an intersection 100 of the bottom edge 75 and the first side edge 80. The first side 50 is joined at its second side edge 85 to the first side edge 40 of the square front side 15.

A square second side 105 is provided. The second side 105 has an outer surface 110, an inner surface 115, a top edge 120, a bottom edge 125, a first side edge 130, a second side edge 135 and a second diagonal perforation 140, the second diagonal perforation 140 extends from an intersection 145 of the top edge 120 and the second side edge 135 to an intersection 150 of the bottom edge 125 and the first side edge 130. The second side 105 is joined at its first side edge 130 to the second side edge 45 of the square front side 15. A square back side 155 is provided. The back side 155 has an outer surface 160, an inner surface 165, a top edge 170, a bottom edge 175, a first side edge 180 and a second side edge 185. The back side 155 is joined at its first side edge 180 to the second side edge 135 of the square second side 105.

A connecting tab 190 is provided. The connecting tab 190 is joined to the first side edge 80 of the square first side 50 and extends outwardly from it. The connecting tab 190 is removably attached to the inner surface 165 of the square back side 155 adjacent the second side edge 185 of the back side 155. A first tensioning portion 195 is provided. The first tensioning portion 195 is joined at an attaching edge 200 to the top edge 30 of the square front side 15 and includes a first means 205 for attaching a tensioning means 210. A second tensioning portion 215 is provided. The second tensioning portion 215 is joined at an attaching edge 220 to the top edge 170 of the square back side 155 and includes a second means 225 for attaching a tensioning means 210.

Figure 3:
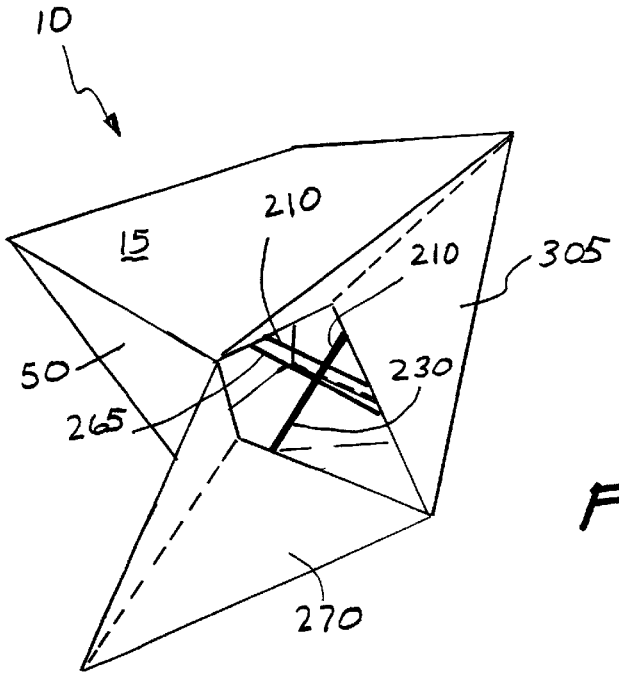
FIG. 3 is a perspective view of the FIG. 1 embodiment in a further erected state illustrating the tensioning means.
Figure 4:
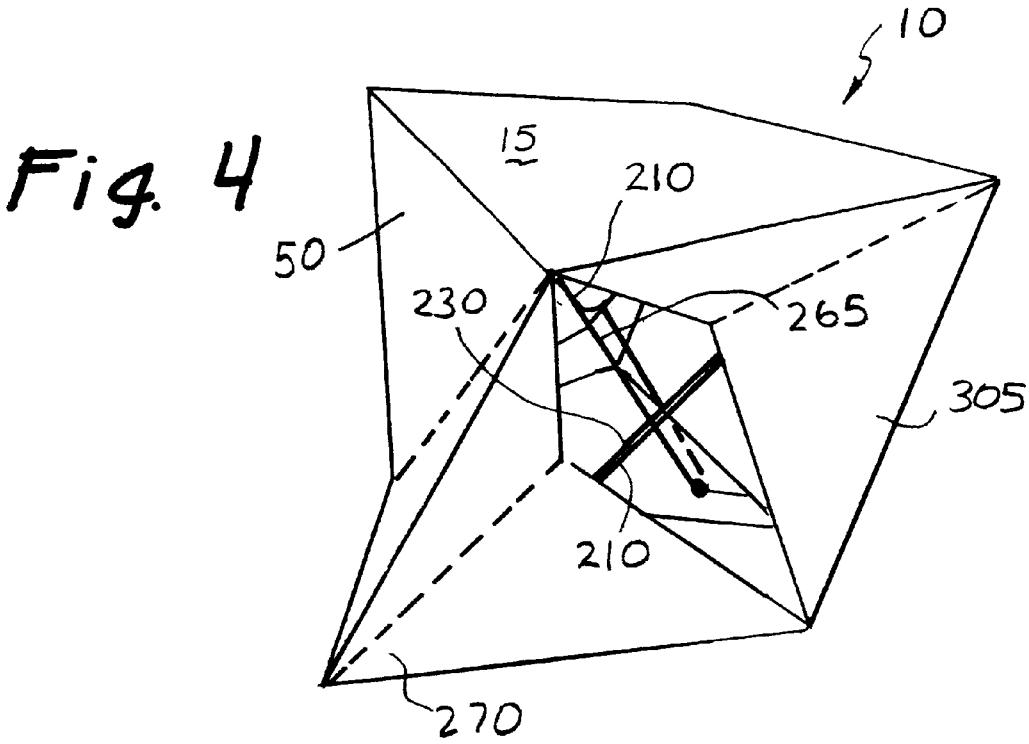
FIG. 4 is a perspective view of the FIG. 1 embodiment in a still further erected state illustrating the means for attaching the tensioning means.
Figure 5:
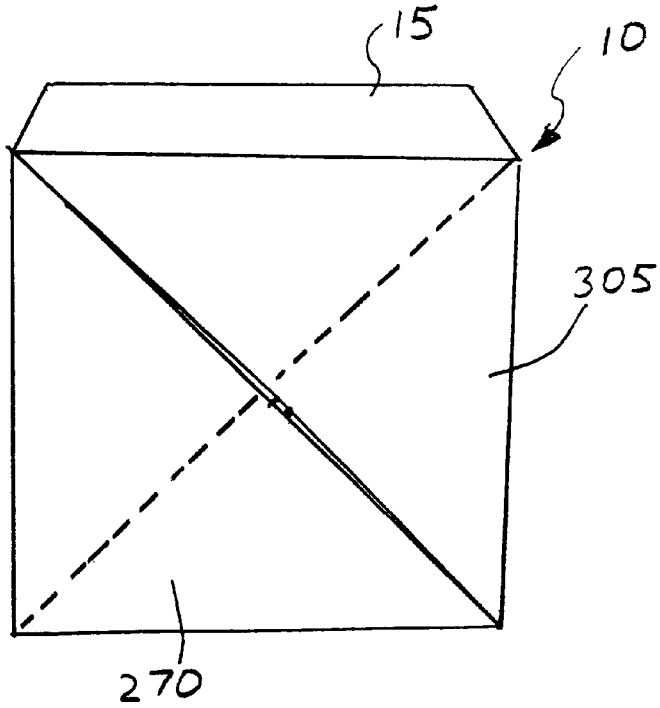
FIG. 5 is a perspective view of the FIG. 1 embodiment in a fully erected state.
Figure 12:
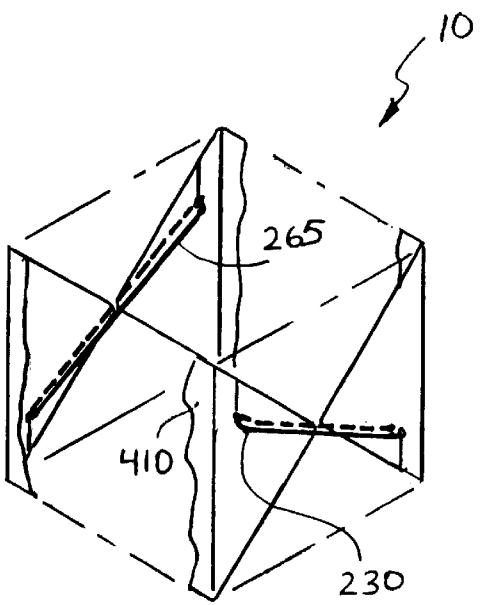
FIG. 12 is a breakaway perspective view of the FIG. 1 embodiment illustrating the attachment of the tensioning means.
Figure 8:
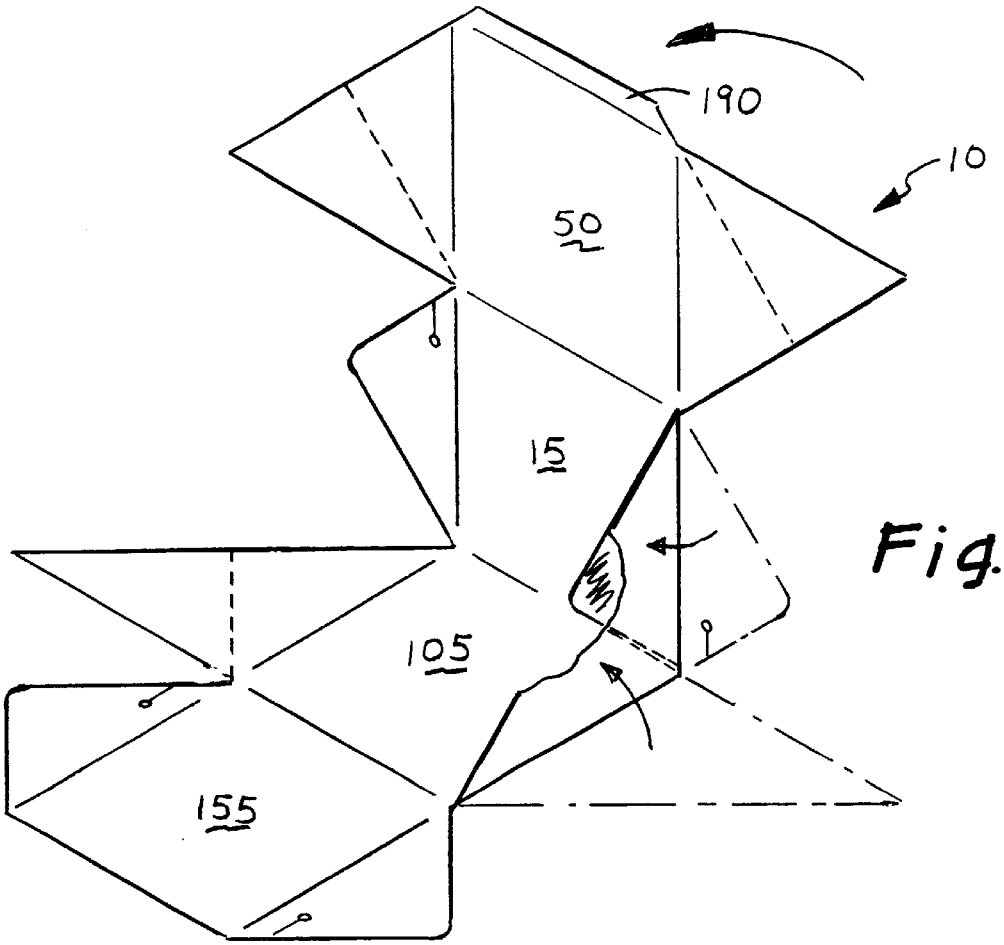
FIG. 8 is a perspective view of the FIG. 1 embodiment at a first stage of assembly.
Figure 11:
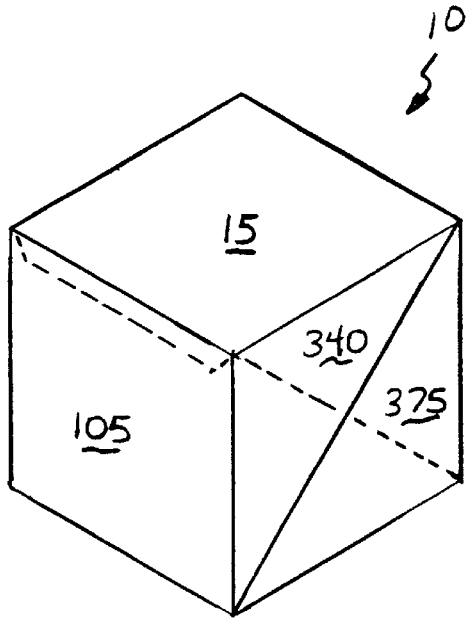
FIG. 11 is a perspective view of the FIG. 1 embodiment at a final stage of assembly.
Figure 9:
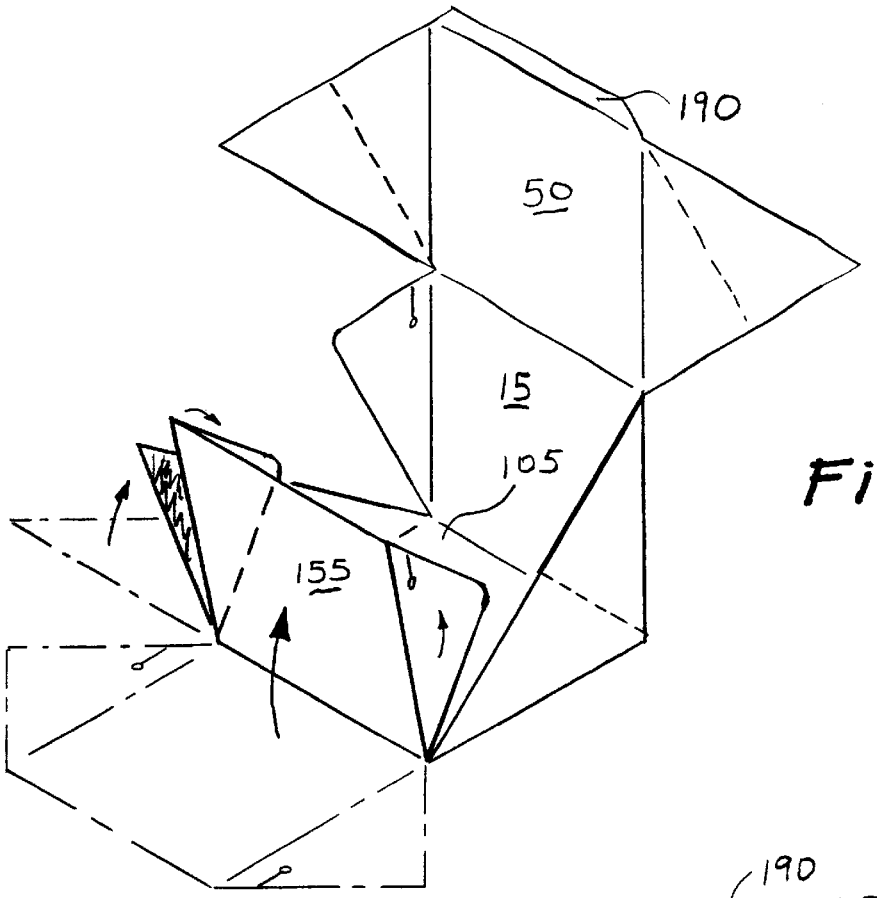
FIG. 9 is a perspective view of the FIG. 1 embodiment at a next stage of assembly.
Figure 10:
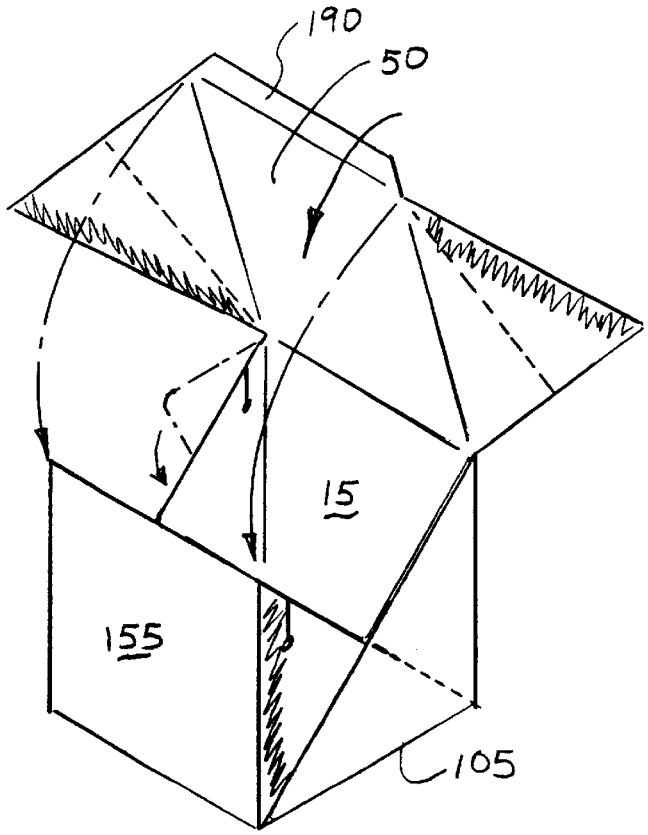
FIG. 10 is a perspective view of the FIG. 1 embodiment at a further stage of assembly.

As illustrated in FIGS. 3, 4 and 12, a first tensioning means 230 is provided. The first tensioning means 230 is attached to the first means for attaching a tensioning means 205 and the second means for attaching a tensioning means 225 and urges the first tensioning portion 195 toward the second tensioning portion 215. As illustrated in FIG. 6, a third tensioning portion 235 is provided. The third tensioning portion 235 is joined at an attaching edge 240 to the bottom edge 35 of the square front side 15 and includes a third means 245 for attaching a tensioning means 210. A fourth tensioning portion 250 is provided. The fourth tensioning portion 250 is joined at an attaching edge 255 to the bottom edge 175 of the square back side 155 and includes a fourth means 260 for attaching a tensioning means 210. A second tensioning means 265 is provided. The second tensioning means 265 is attached to the third means for attaching a tensioning means 245 and the fourth means for attaching a tensioning means 260 and urges the third tensioning portion 235 toward the fourth tensioning portion 250.

A first side top portion 270 is provided. The first side top portion 270 is formed as a right triangle and has a first adjacent side 275, a second adjacent side 280 and a first hypotenuse 285. The first side top portion 270 is joined at the first adjacent side 275 to the top edge 70 of the square first side 50 and has a third diagonal perforation 290 extending from an intersection 295 of the top edge 70 and the first side edge 80 of the square first side 50 to a center point 300 of the first hypotenuse 285. The second adjacent side 280 is removably attached to the first tensioning portion 195 adjacent the top edge 30 of the square front side 15.

A second side top portion 305 is provided. The second side top portion 305 is formed as a right triangle and has a third adjacent side 310, a fourth adjacent side 315 and a second hypotenuse 320. The second side top portion 305 is joined at the third adjacent side 310 to the top edge 120 of the square second side 105 and has a fourth diagonal perforation 325 extending from an intersection 330 of the top edge 120 and the first side edge 130 of the square second side 105 to a center point 335 of the second hypotenuse 320. The fourth adjacent side 315 is removably attached to the second tensioning portion 215 adjacent the top edge 170 of the square back side 155.

A first side bottom portion 340 is provided. The first side bottom portion 340 is formed as a right triangle and has a fifth adjacent side 345, a sixth adjacent side 350 and a third hypotenuse 355. The first side bottom portion 340 is joined at the fifth adjacent side 345 to the bottom edge 75 of the square first side 50 and has a fifth diagonal perforation 360 extending from an intersection 365 of the bottom edge 75 and the second side edge 85 of the square first side 50 to a center point 370 of the third hypotenuse 355. The sixth adjacent side 350 is removably attached to the third tensioning portion 235 adjacent the bottom edge 35 of the square front side 15.

A second side bottom portion 375 is provided. The second side bottom portion 375 is formed as a right triangle and has a seventh adjacent side 380, an eighth adjacent side 385 and a fourth hypotenuse 390. The second side bottom portion 375 is joined at the seventh adjacent side 380 to the bottom edge 125 of the square second side 105 and has a sixth diagonal perforation 395 extending from an intersection 400 of the bottom edge 125 and the second side edge 135 of the square second side 105 to a center point 405 of the fourth hypotenuse 390. The eighth adjacent side 385 is removably attached to the fourth tensioning portion 250 adjacent the bottom edge 175 of the square back side 155.

Figure 1:
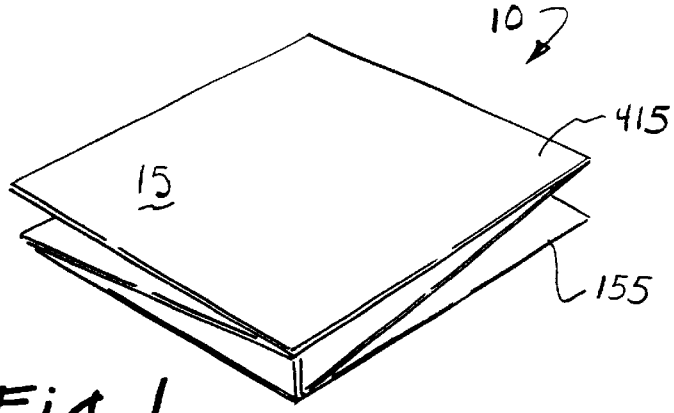
FIG. 1 is a perspective view of the preferred embodiment of the invention in a flattened, folded state.
Figure 2:
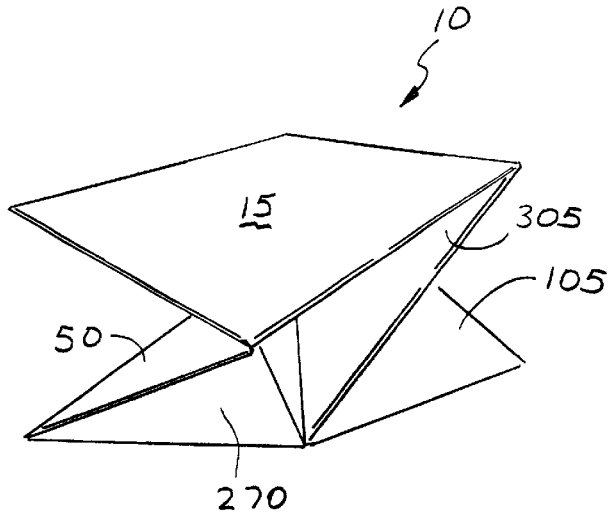
FIG. 2 is a perspective view of the FIG. 1 embodiment in a partially erected state.

When the folding three dimensional construction in the form of a cube 10 is twisted about the first 90 and second 140 diagonal perforations, the third 290, fourth 325, fifth 360 and sixth 395 perforations will be displaced toward a center 410 of the cube 10 while stretching the first 230 and second 265 tensioning means and the cube 10 will then collapse, as illustrated in FIG. 1, into a flattened square 415 and the tension in the first 230 and second 265 tensioning means will be reduced.

In a variant of the invention, as illustrated in FIGS. 6–11, the three dimensional construction 10 is formed from a single blank 420.

In another variant, the construction 10 is formed from material selected from the group includes: paperboard, corrugated cardboard, plastic and reinforced fabric.

In a further variant, the first 230 and second 265 tensioning means are selected from the group includes: rubber bands, elastic and coil springs.

In a further variant of the invention, as illustrated in FIG. 6, the first 195, second 215, third 235 and fourth 250 tensioning portions include an adjoining edge 425. The adjoining edge 425 intersects the attaching edge 200, 220, 240, 255 of the tensioning portions 195, 215, 235, 250.

In a final variant of the invention, as illustrated in FIGS. 6–10, the means 205, 225, 245, 260 for attaching a tensioning means 210 includes an orifice 430. The orifice 430 penetrates the tensioning portions 195, 215, 235, 250 and is spaced from the attaching edge 200, 220, 240, 255 and spaced from the adjoining edge 425. A slit 435 is provided. The slit 435 extends from the orifice 430 to the adjoining edge 425. When an attaching end 440 of either of the first 230 and second 265 tensioning means is inserted through the slit 435, the tensioning means 230, 265 will be retained in the orifice 430.

The folding three-dimensional construction in the form of a cube 10 has been described with reference to particular embodiments. Other modifications and enhancements can be made without departing from the spirit and scope of the claims that follow.

What is claimed is:

1. A folding three dimensional construction in the form of a cube, comprising:

a square front side, a square back side, square first and second sides, said first and second sides being joined at side edges to side edges of said front side and said back side, at least one pair of said side edges being removably attached;

said square first side having a diagonal perforation extending from an upper corner to a lower corner and said square second side having a diagonal perforation extending from an opposite upper corner to an opposite lower corner;

a first triangular top portion, said first top portion being formed as a right triangle having a hypotenuse and first and second adjacent sides and having a perforation line extending from a midpoint of said hypotenuse to an intersection of said adjacent sides;

said first triangular top portion being joined at said first adjacent side to a top edge of said square first side and removably attached adjacent a top edge of said square front side;

a second triangular top portion, said second top portion being formed as a right triangle having a hypotenuse and first and second adjacent sides and having a perforation line extending from a midpoint of said hypotenuse to an intersection of said adjacent sides;

said second triangular top portion being joined at said first adjacent side to a top edge of said square second side and removably attached adjacent a top edge of said square back side;

a first triangular bottom portion, said first bottom portion being formed as a right triangle having a hypotenuse and first and second adjacent sides and having a perforation line extending from a midpoint of said hypotenuse to an intersection of said adjacent sides;

said first triangular bottom portion being joined at said first adjacent side to a bottom edge of said square first side and removably attached adjacent a bottom edge of said square front side;

a second triangular bottom portion, said second bottom portion being formed as a right triangle having a hypotenuse and first and second adjacent sides and having a perforation line extending from a midpoint of said hypotenuse to an intersection of said adjacent sides;

said second triangular bottom portion being joined at said first adjacent side to a bottom edge of said square second side and removably attached adjacent a bottom edge of said square back side;

first, second, third and fourth tensioning portions, said tensioning portions being joined top edges of said front and back sides and bottom edges of said front and back sides, respectively;

each of said tensioning portions being disposed beneath one of said first and second triangular top and bottom portions;

each of said tensioning portions having a means for attaching a tensioning means;

a first tensioning means, said first tensioning means connecting said first tensioning portion to said second tensioning portion and urging said portions toward one another;

a second tensioning means, said second tensioning means connecting said third tensioning portion to said fourth tensioning portion and urging said portions toward one another; and whereby, when the construction in the form of a cube is twisted about the diagonal perforations, the perforations will be displaced toward a center of the cube while stretching the first and second tensioning means and the cube will then collapse into a flattened square and the tension in the first and second tensioning means will be reduced.

2. A folding three dimensional construction in the form of a cube, comprising:

a square front side, said front side having an outer surface, an inner surface, a top edge, a bottom edge, a first side edge and a second side edge;

a square first side, said first side having an outer surface, an inner surface, a top edge, a bottom edge, a first side edge, a second side edge and a first diagonal perforation, said first diagonal perforation extending from an intersection of said top edge and said second side edge to an intersection of said bottom edge and said first side edge;

said first side being joined at its second side edge to the first side edge of said square front side;

a square second side, said second side having an outer surface, an inner surface, a top edge, a bottom edge, a first side edge, a second side edge and a second diagonal perforation, said second diagonal perforation extending from an intersection of said top edge and said second side edge to an intersection of said bottom edge and said first side edge;

said second side being joined at its first side edge to the second side edge of said square front side;

a square back side, said back side having an outer surface, an inner surface, a top edge, a bottom edge, a first side edge and a second side edge;

said back side being joined at its first side edge to the second side edge of said square second side;

a connecting tab, said connecting tab being joined to said first side edge of said square first side and extending outwardly therefrom, said connecting tab being removably attached to the inner surface of said square back side adjacent the second side edge thereof;

a first tensioning portion, said first tensioning portion being joined at an attaching edge to said top edge of said square front side and comprising a first means for attaching a tensioning means;

a second tensioning portion, said second tensioning portion being joined at an attaching edge to said top edge of said square back side and comprising a means for attaching a tensioning means;

a first tensioning means, said first tensioning means being attached to said first means for attaching a tensioning means and said second means for attaching a tensioning means and urging said first tensioning portion toward said second tensioning portion;

a third tensioning portion, said third tensioning portion being joined at an attaching edge to said bottom edge of said square front side and comprising a third means for attaching a tensioning means;

a fourth tensioning portion, said fourth tensioning portion being joined at an attaching edge to said bottom edge of said square back side and comprising a fourth means for attaching a tensioning means;

a second tensioning means, said second tensioning means being attached to said third means for attaching a tensioning means and said fourth means for attaching a tensioning means and urging said third tensioning portion toward said fourth tensioning portion;

a first side top portion, said first side top portion being formed as a right triangle and having a first adjacent side, a second adjacent side and a first hypotenuse, said first side top portion being joined at said first adjacent side to the top edge of said square first side and having a third diagonal perforation extending from an intersection of said top edge and the first side edge of said square first side to a center point of said first hypotenuse;

said second adjacent side being removably attached to said first tensioning portion adjacent the top edge of said square front side;

a second side top portion, said second side top portion being formed as a right triangle and having a third adjacent side, a fourth adjacent side and a second hypotenuse, said second side top portion being joined at said third adjacent side to the top edge of said square second side and having a fourth diagonal perforation extending from an intersection of said top edge and the first side edge of said square second side to a center point of said second hypotenuse;

said fourth adjacent side being removably attached to said second tensioning portion adjacent the top edge of said square back side;

a first side bottom portion, said first side bottom portion being formed as a right triangle and having a fifth adjacent side, a sixth adjacent side and a third hypotenuse, said first side bottom portion being joined at said fifth adjacent side to the bottom edge of said square first side and having a fifth diagonal perforation extending from an intersection of said bottom edge and the second side edge of said square first side to a center point of said third hypotenuse; and said sixth adjacent side being removably attached to said third tensioning portion adjacent the bottom edge of said square front side;

a second side bottom portion, said second side bottom portion being formed as a right triangle and having a seventh adjacent side, an eighth adjacent side and a fourth hypotenuse, said second side bottom portion being joined at said seventh adjacent side to the bottom edge of said square second side and having a sixth diagonal perforation extending from an intersection of said bottom edge and the second side edge of said square second side to a center point of said fourth hypotenuse;

said eighth adjacent side being removably attached to said fourth tensioning portion adjacent the bottom edge of said square back side; and whereby, when the construction in the form of a cube is twisted about the first and second diagonal perforations, the third, fourth, fifth and sixth perforations will be displaced toward a center of the cube while stretching the first and second tensioning means and the cube will then collapse into a flattened square and the tension in the first and second tensioning means will be reduced.

3. A folding three dimensional construction in the form of a cube, as described in claim 1 or claim 2, wherein the construction is formed from a single blank.

4. A folding three dimensional construction in the form of a cube, as described in claim 1 or claim 2, wherein the construction is formed from material selected from the group consisting of:

paperboard, corrugated cardboard, plastic and reinforced fabric.

5. A folding three dimensional construction in the form of a cube, as described in claim 1 or claim 2, wherein the first and second tensioning means are selected from the group consisting of:

rubber bands, elastic and coil springs.

6. A folding three dimensional construction in the form of a cube, as described in claim 5, wherein the first, second, third and fourth tensioning portions further comprise an adjoining edge, said adjoining edge intersecting said attaching edge of said tensioning portions.

7. A folding three dimensional construction in the form of a cube, as described in claim 6, wherein the means for attaching a tensioning means further comprises:

a orifice, said orifice penetrating said tensioning portions and being spaced from said attaching edge and spaced from said adjoining edge;

a slit, said slit extending from said orifice to said adjoining edge; and whereby, when an attaching end of either of said first and second tensioning means is inserted through said slit, said tensioning means will be retained in said orifice.

* * * * *